US009302465B2

(12) United States Patent
Roberts et al.

(10) Patent No.: US 9,302,465 B2
(45) Date of Patent: Apr. 5, 2016

(54) APPARATUS, ASSEMBLY AND METHOD FOR DRY CLEANING A FLEXOGRAPHIC PRINTING PLATE CARRIED ON A PLATE CYLINDER THAT INCLUDES OPTIMIZED CLEANING FUNCTIONALITIES

(71) Applicant: XDS HOLDINGS INC., Neenah, WI (US)

(72) Inventors: Jack Roberts, Neenah, WI (US); Jeffrey M. DeVries, Avon Lake, OH (US)

( * ) Notice: Subject to any disclaimer, the term of this patent is extended or adjusted under 35 U.S.C. 154(b) by 0 days.

(21) Appl. No.: 14/499,928

(22) Filed: Sep. 29, 2014

(65) Prior Publication Data

US 2015/0090142 A1 Apr. 2, 2015

Related U.S. Application Data

(60) Provisional application No. 61/884,040, filed on Sep. 28, 2013, provisional application No. 62/025,160, filed on Jul. 16, 2014.

(51) Int. Cl.
*B41F 35/00* (2006.01)
*B41F 35/02* (2006.01)

(52) U.S. Cl.
CPC ..... *B41F 35/02* (2013.01)

(58) Field of Classification Search
CPC ..... B41P 2235/246; B41F 35/02
USPC ..... 101/425
See application file for complete search history.

(56) References Cited

U.S. PATENT DOCUMENTS

| | | | | |
|---|---|---|---|---|
| 4,555,989 | A * | 12/1985 | Marass et al. | 101/424 |
| 5,138,945 | A * | 8/1992 | Lee | B41F 35/02 101/423 |
| 5,275,104 | A * | 1/1994 | Corrado et al. | 101/425 |
| 5,385,096 | A * | 1/1995 | Suzuki | B41F 35/02 101/425 |
| 6,196,128 | B1 * | 3/2001 | Corrado | B08B 7/0028 101/425 |
| 6,568,326 | B1 * | 5/2003 | Corrado | B41F 23/002 101/423 |
| 7,143,693 | B2 * | 12/2006 | Ruschkowski | 101/425 |
| 2003/0075065 | A1 * | 4/2003 | Loos | B41F 33/14 101/425 |
| 2004/0244618 | A1 * | 12/2004 | Egan | 101/425 |
| 2005/0061182 | A1 * | 3/2005 | Ebina | B41F 35/00 101/425 |
| 2012/0240800 | A1 * | 9/2012 | Fumagalli | B41F 13/0024 101/425 |

* cited by examiner

*Primary Examiner* — Anthony Nguyen
(74) *Attorney, Agent, or Firm* — Joseph S. Heino; Patrick M. Bergin

(57) ABSTRACT

A dry cleaning apparatus, assembly and method provides for a dry flexographic plate cleaner apparatus that is configured as a unitary subassembly to be used within a printing press assembly. The cleaner apparatus and subassembly comprise a plurality of motorized drives such that, among other things, a cleaning roller can be moved towards and away from the rotating printing plate so as to achieve optimum spacing. This also allows the press operator to make adjustments to the cleaner apparatus and subassembly without having to stop the printing press assembly. The apparatus and subassembly is further removable from the printing press assembly as may be desired or required for service. Additionally, the apparatus, assembly and method of the present invention also provides for use of at least one controller for electronically controlling the apparatus in accordance with the method and implementing optimized cleaning capabilities and functionalities.

13 Claims, 7 Drawing Sheets

APPARATUS, ASSEMBLY AND METHOD FOR DRY CLEANING A FLEXOGRAPHIC PRINTING PLATE CARRIED ON A PLATE CYLINDER THAT INCLUDES OPTIMIZED CLEANING FUNCTIONALITIES

This Application claims the benefit of U.S. Provisional Application No. 61/884,040, filed Sep. 28, 2013 and U.S. Provisional Application No. 62/025,160 filed Jul. 16, 2014.

FIELD OF THE INVENTION

The present invention relates generally to flexographic printing machines and systems. More specifically, the present invention relates to a dry cleaning apparatus and assembly that is used for cleaning the outer surface of a flexographic printing plate as the plate rotates on a plate cylinder. It also relates to a method that is drawn to the use of such apparatus and assembly. It also relates to providing one or more supplemental sub-systems and methods for optimizing one or more cleaning functionalities used with an interface to at least one controller that is incorporated into the apparatus and assembly of the present invention.

BACKGROUND OF THE INVENTION

In the art of flexographic printing, a plate is carried on a rotating cylinder. The plate carries a print medium that is then applied to a surface. During the printing process, certain debris, such as dust, paper fibers and other residue, is unavoidably deposited onto the plate. This type of debris can result in poor print quality and needs to be removed from the plate to maintain optimum print quality. It is also desirable to remove such debris without having to shut down the printing press because doing so adversely impacts productivity. That is, it is known in the prior art that shutting down the press to manually wipe debris from the printing plate accomplishes the intended purpose, but at the expense of lowering print production. Other methods are known in the art that use a more mechanized process for cleaning a printing plate, but do so by degrading the surface of the printing plate by repeated cleanings and imprecise placement of a cleaning device relative to the printing plate. These mechanized processes of the prior art also result in a degradation of print quality due to the degradation of the surface of the printing plate. A "dry" system is preferred in that it minimizes color deviation in the ink and produces no waste water, which water then needs to be properly disposed of.

Accordingly, it is an object of the present invention to provide An apparatus, assembly and method for dry cleaning of a flexographic printing plate, the plate being carried on a plate cylinder, as the plate rotates on a print cylinder and without stopping the printing press whereby minimal degradation of the printing plate surface is realized. It is another object to provide such an apparatus, assembly and method whereby the apparatus is adjustable in several axes relative to the rotating plate so as to optimize cleaning. It is still another object to provide such an apparatus, assembly and method whereby the apparatus and assembly can be easily removed from the printing press for service and maintenance when necessary. It is yet another object of the present invention to provide such an apparatus, assembly and method that incorporates a number of added performance characteristics that are intended to optimize cleaning capabilities when the apparatus, assembly and method is used as intended.

SUMMARY OF THE INVENTION

The dry cleaning apparatus, assembly and method of the present invention has obtained these objects and others. It provides for a dry flexographic plate cleaner apparatus that is configured as a unitary subassembly to be used within a printing press assembly. The cleaner apparatus and subassembly comprise a plurality of motorized drives such that, among other things, a cleaning head can be moved towards and away from the rotating printing plate so as to achieve optimum spacing. This also allows the press operator to make adjustments to the cleaner apparatus and subassembly without having to stop the printing press assembly, which avoids press downtime and maintains desired production speeds. The cleaner apparatus and subassembly is further removable from the printing press assembly as may be desired or required for service. Additionally, the apparatus, assembly and method of the present invention, which is used for dry cleaning a printing plate that is carried on a print cylinder, also provides for use of at least one controller for electronically controlling the apparatus in accordance with the method and implementing optimized cleaning capabilities and functionalities.

The foregoing and other features of the dry cleaning apparatus, assembly and method of the present invention will be apparent from the detailed description that follows.

DETAILED DESCRIPTION

Figure 1:
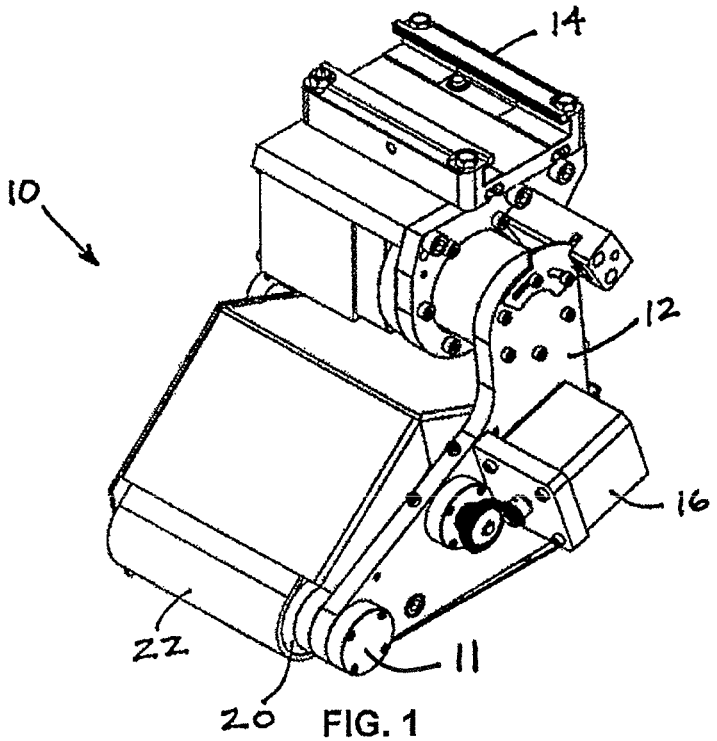
FIG. 1 is a perspective view of one preferred embodiment of the dry cleaning apparatus and subassembly that is constructed in accordance with the present invention.
Figure 2:
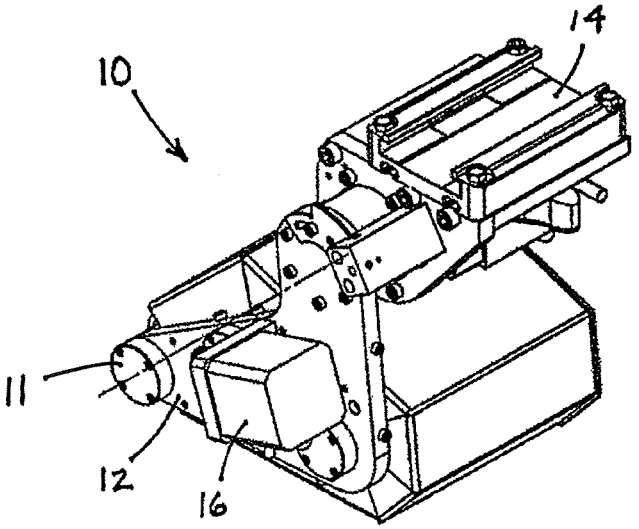
FIG. 2 is another perspective view of the dry cleaning apparatus and subassembly shown in FIG. 1.
Figure 3:
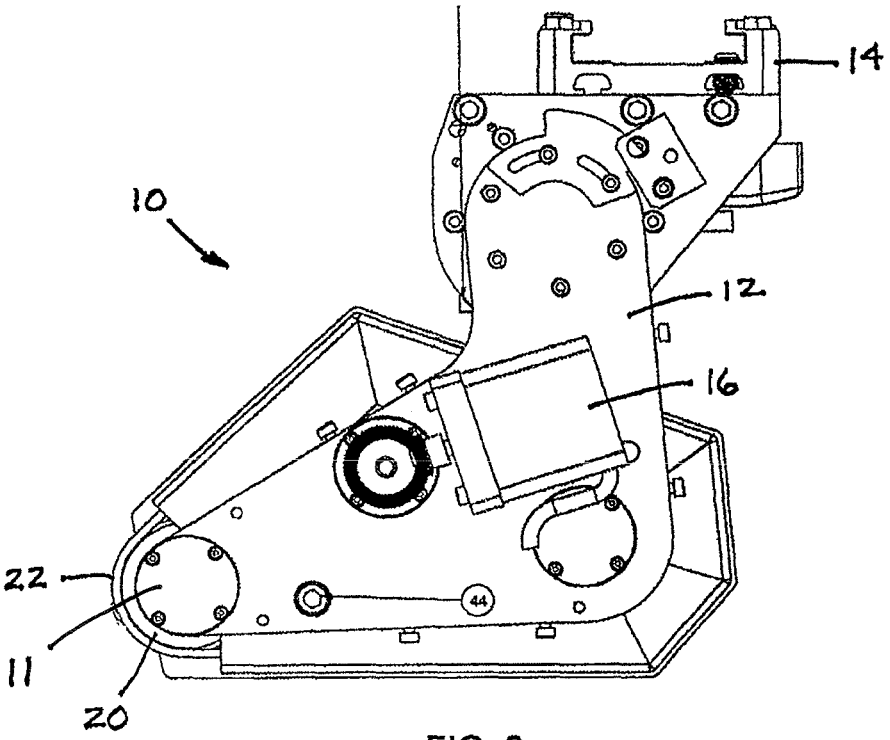
FIG. 3 is a side elevation view of the apparatus and subassembly shown in FIGS. 1 and 2.
Figure 4:
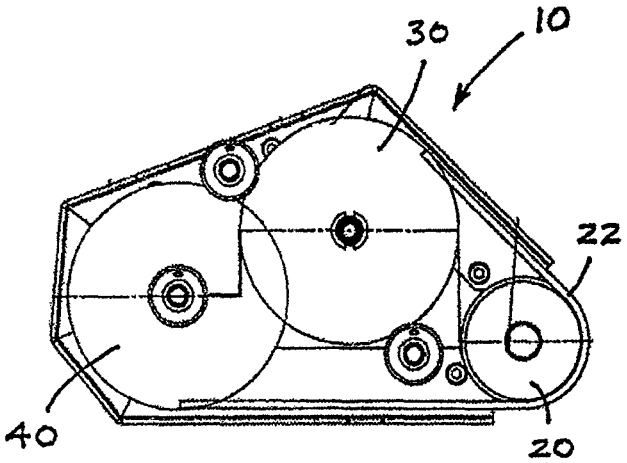
FIG. 4 is a partially sectioned side elevation view of the apparatus and subassembly from the side opposite that shown in FIG. 3.

Referring now to the drawing views in detail, wherein like numbered elements refer to like elements throughout the drawing, FIGS. 1 through 4 illustrate a preferred and representative embodiment of the printing plate cleaner structure (also alternatively and interchangeably referred to in this detailed description as a "plate cleaner," a "plate cleaner apparatus" or a "plate cleaner subassembly"), generally identified 10, of a dry cleaning apparatus and subassembly that is fabricated in accordance with the present invention.

As shown, the plate cleaner 10 comprises a frame having a first frame member 12 and a second frame member 14. In the preferred embodiment, the plate cleaner 10 comprises three motors—a linear actuator motor 52, a cloth rewind motor 16 and an impression or "tilt" motor 18. It is to be understood that such motors may be one motor, or any combination of motors, from a group consisting of electric motors, hydraulic motors, pneumatic motors and the like, the type of motors used not being a limitation of the present invention.

Figure 5:
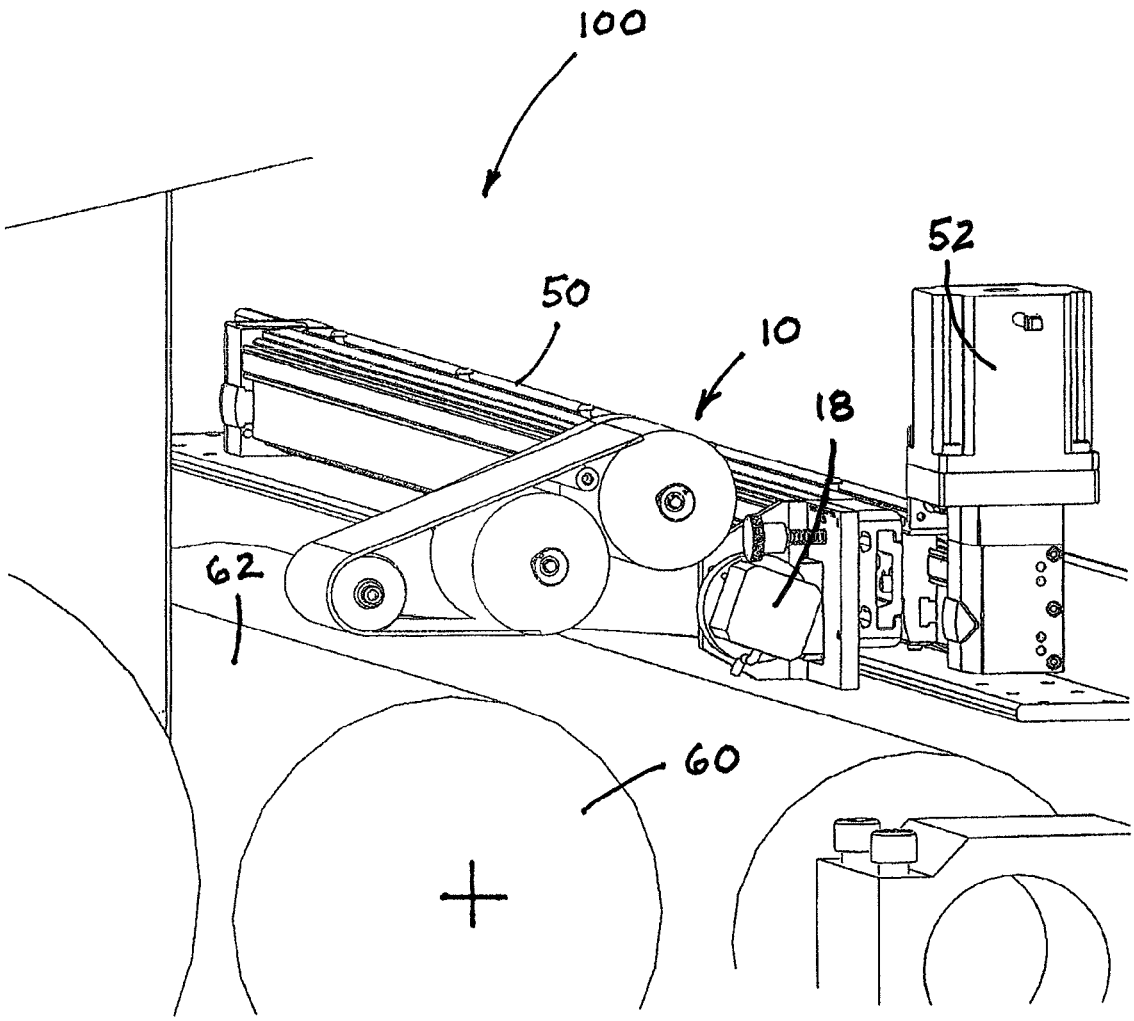
FIG. 5 is a perspective view of the dry cleaning apparatus and subassembly as used within a printing press assembly, and showing the apparatus and subassembly in the "parked" position relative to the rotating printing plate of the printing press assembly.
Figure 6:
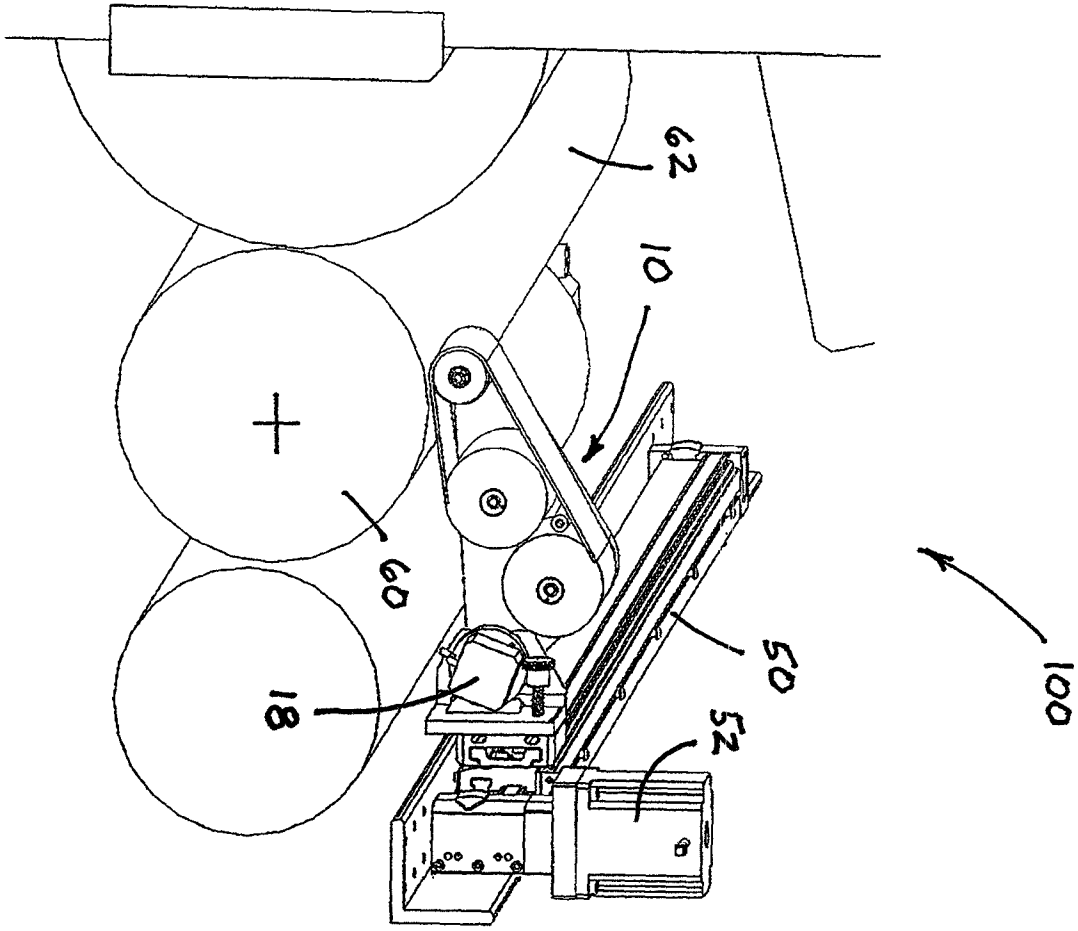
FIG. 6 is a perspective view similar to that of FIG. 5 but showing the apparatus and subassembly in the "active" position relative to the rotating printing plate of the printing press assembly.
Figure 7:
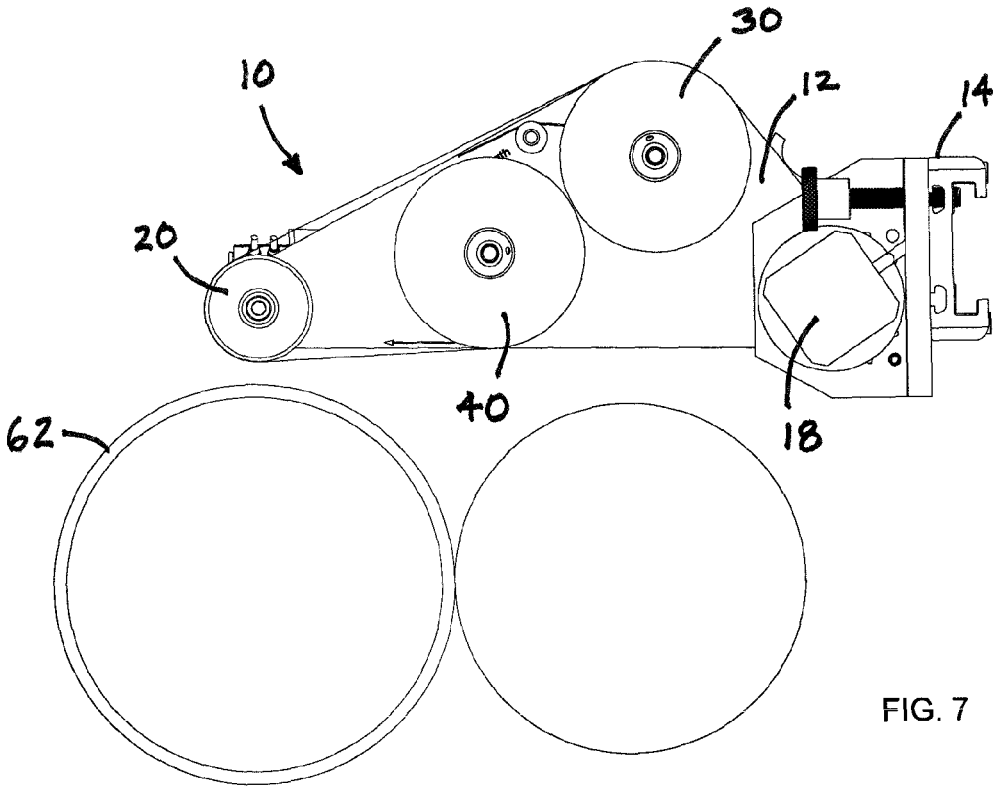
FIG. 7 is a side elevational view of a portion of the dry cleaning subassembly illustrated in FIG. 5.
Figure 8:
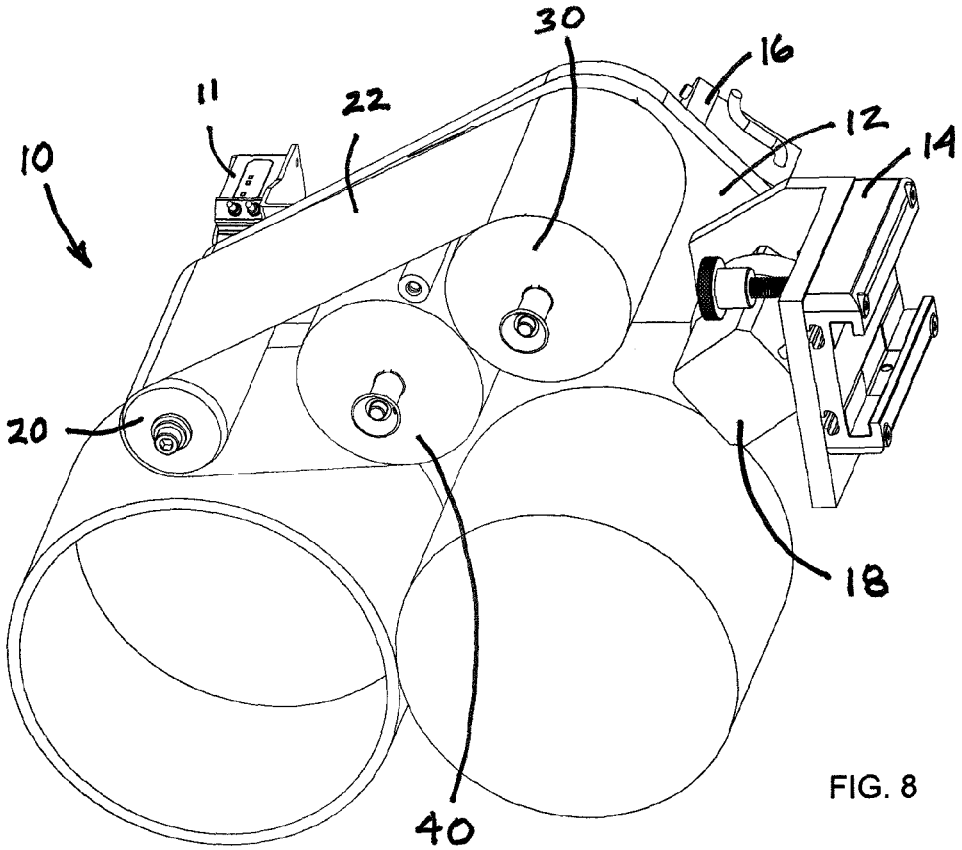
FIG. 8 is a perspective view similar to that shown in FIG. 7.

The frame 12, 14 of the plate cleaner 10 also comprises a roller 20 and two spindles 30, 40. See FIG. 4. In the preferred embodiment, the frame of the plate cleaner 10 is disposed above the printing plate cylinder 60 of a printing press assembly, generally identified 100. See FIGS. 5 and 6. In this embodiment, the roller 20 is disposed toward the bottom of the frame 12, 14 and the roller 20 has an axis that is parallel to that of the printing plate cylinder 30. The roller 20 is also that structure of the plate cleaner 10 over which a portion of dry cleaning material 22 is pulled, the dry cleaning material 22 being fed from a web of such material that is disposed within the frame 12, 14 of the plate cleaner 10. It is also within the scope of the present invention to provide a version of plate cleaner 10 having a roller 20 that adjusts impression using an eccentric cam on its roller shaft (not shown). This version allows for a smaller footprint and provides more versatility to the functionality of the plate cleaner 10.

In the preferred embodiment, one of the spindles is an "unwind" spindle 40 that carries the web of unsoiled dry cleaning material, such as a woven or non-woven polyester, or any other absorbent cloth or cloth-like material. The other spindle is a "rewind" spindle 30 that pulls the web of dry cleaning material from the unwind spindle 40, then about a portion of outer surface of the roller 20 and back to the rewind spindle 30. At the point of rewind, the dry cleaning material 22 is soiled with printing debris and ink, as described above.

However, it is to be understood that the exact placement of the rewind and unwind spindles 30, 40, respectively, relative to the plate cleaner subassembly 10 of the present invention is not a limitation of the present invention. That is, different configurations of the spindles are available depending on the specific application and use to which the plate cleaner 10 of the present invention is desired or required. However, the functionality of the pulling of the dry cleaning material 22 from an unwind spindle 40, across a portion of the roller 20 and back to a rewind spindle 30 is required regardless of placement of those structures within the plate cleaner 10. It is also intended that the axes of the roller 20 and the spindles 30, 40 be parallel with the longitudinal axis of the print plate cylinder 60, although the spindles 30, 40 could be used with other structures to accomplish feeding or take-up of the unsoiled or soiled dry cleaning material, respectively.

The linear actuator motor 52 provides a means for moving the plate cleaner 10 longitudinally along a track subassembly 50 that is also parallel to the longitudinal axis of the print plate cylinder 60. Again, see FIGS. 5 and 6. The second frame portion 14 is used to move along the track subassembly 50. The cloth roller motor 16 pulls a web of dry cleaning material from the unwind spindle 40 to the rewind spindle 30 via worm gears, although other drive mechanisms could be used. The impression or "tilt" motor allows the roller of the plate cleaner 10 to move toward and away from the surface 62 of a printing plate that is attached to the print cylinder 60. This last structure is significant in that it provides functionality such that relatively tight or precise control of the pressure that the plate cleaner roller places on the printing plate surface 62 as the printing plate and the print cylinder rotate is attained. This allows the cleaning roller 20 and the material 22 to be moved closer to or farther from the surface 62 of the printing plate for optimized spacing and cleaning of that surface thereby placing more or less pressure on the printing plate, respectively. This also allows the operator to make position and pressure adjustments between the plate cleaner 10 and the print plate surface 62 without the need to stop the printing press 100 or the printing process.

Figure 9:
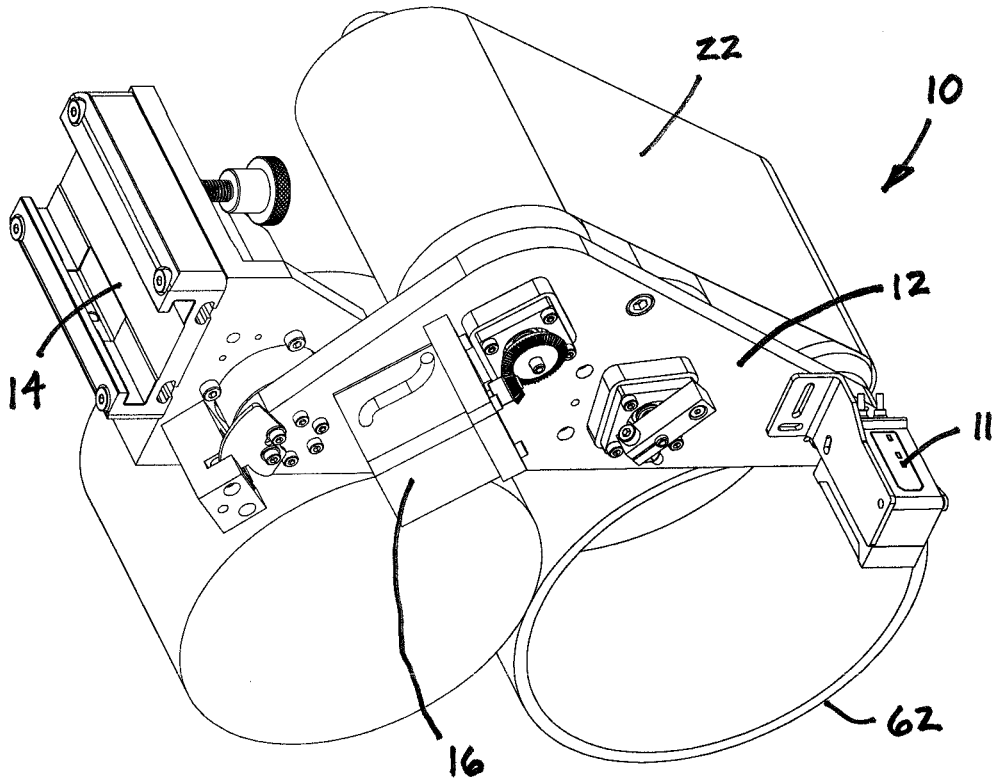
FIG. 9 is a perspective view of the dry cleaning apparatus of shown from the side opposite that shown in FIG. 7.
Figure 10:
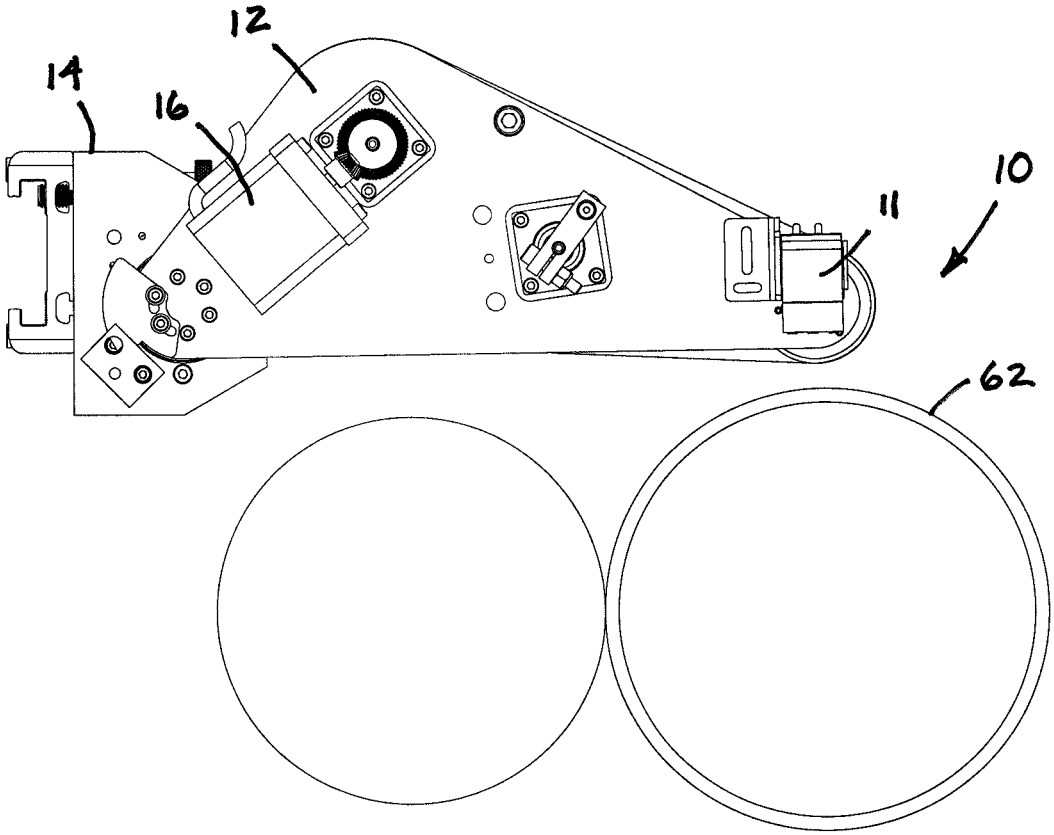
FIG. 10 is a side elevational view of a portion of the dry cleaning subassembly illustrated in FIG. 7, but shown from the opposite side.
Figure 11:
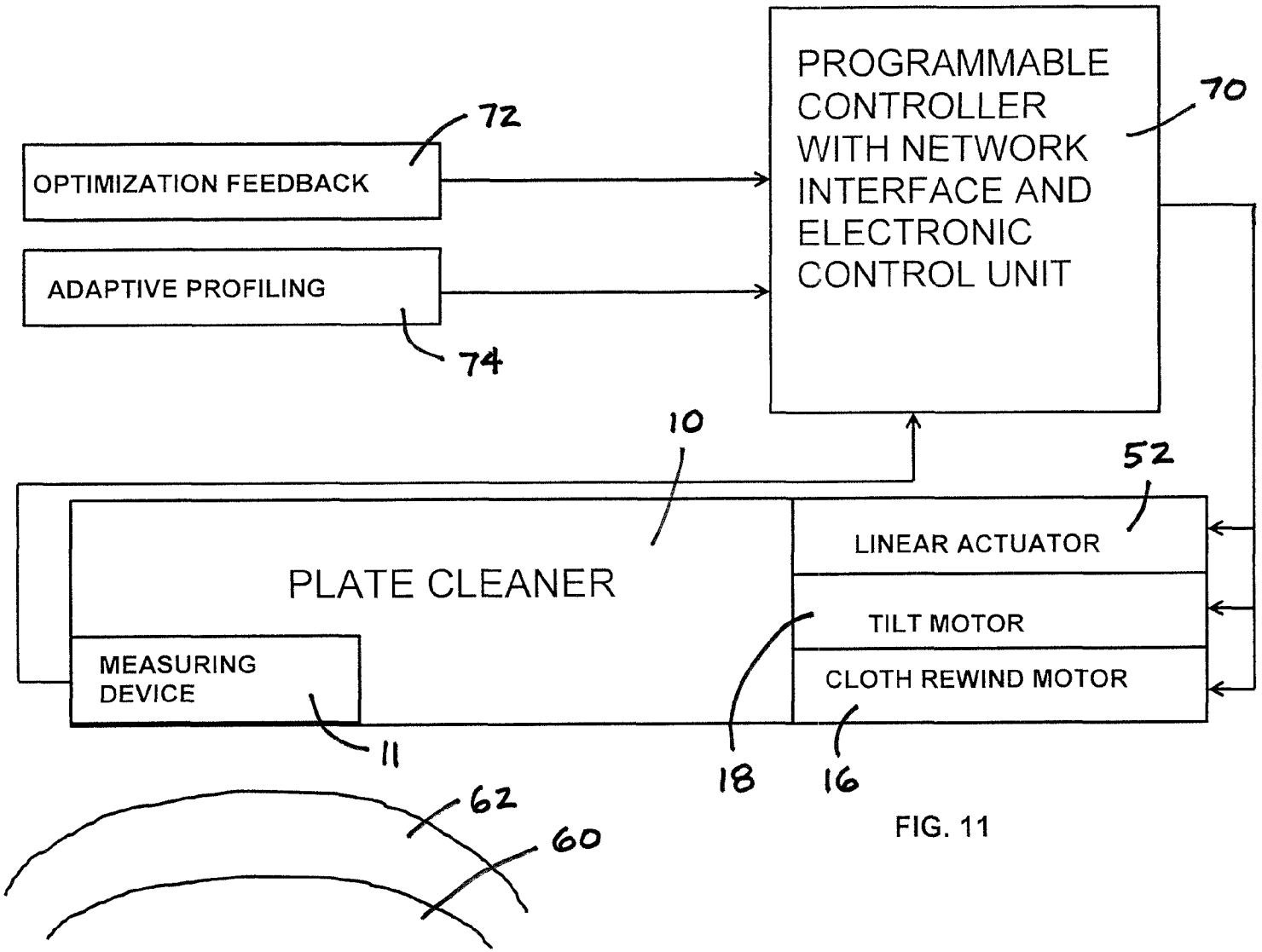
FIG. 11 is a graphical diagram relative to the functionality of the assembly and apparatus of the present invention.

In the preferred embodiment, the roller 20 is a urethane foam covered roller. This allows for further tactile adjustment of the plate cleaner 10 to the surface of the print plate because the roller 20 has some amount of material yield or "give" to it. Also in the plate cleaner 10 of the preferred embodiment, a measuring device 11 is used to determine the distance between the roller 20, and the web 22 passing over it, and the printing plate surface 62 to measure optimum spacing. Such measuring device 11 can be electrical, mechanical, electromechanical or photoelectric, among others. See FIGS. 9-11.

In the plate cleaner 10 of the preferred embodiment, a mounting means and a quick disconnect means is provided such that the plate cleaner 10 can be removed from the printing press assembly 100 for service as may be desired or required.

Also in accordance with the preferred embodiment, the present invention provides an electronic controller 70 that utilizes a controller network interface and an electronic control unit to monitor and control the cleaner directly or in accordance with a preprogrammed scheme. The electronic controller 70 uses programmable software to determine operational parameters and institute electronic commands to the electronic control unit in a pre-determined response operational framework. When the controller 70 is enabled, it monitors certain operational parameters of the plate cleaner 10. In the controller 70 of the present invention, the operational parameters are configurable, allowing the setup to be optimized for a particular method of operation, regardless of the specific application that the plate cleaner is used for, and is programmable to make adjustments accordingly. See FIG. 11.

In accordance with the preferred embodiment, the controller 70 of the present invention also comprises a number of automated and enhanced cleaning functionalities that may or may not be included with the base apparatus, system and method of the present invention. Each functionality is intended to interface with the electronic controller 70 of the present invention to enhance overall operation and optimization of the apparatus, system and method of the present invention.

For example, one functionality comprises the incorporation of a feedback loop that interfaces with the controller 70 and allows the cleaning setup to be fully automated. More specifically, this functionality can include, among other things, the use of a laser to provide a method for assessing cleaning apparatus efficacy and optimization feedback 72. Other technologies could also be used such as the incorporation of ultrasound for providing optimization feedback, strain gauges for measuring torque, among other modalities. It is to be understood that the feedback optimization as is disclosed herein is not limited to the specific embodiments discussed herein and the present invention is not so limited.

In addition to making the process fully automatic, another subassembly can be incorporated to "map" where the printing plate 62 is disposed on the plate cylinder 60 and then configure the cleaning program accordingly. Various other mapping technologies can be incorporated as well and the present invention is not limited in this regard.

Another desired functionality is to include certain testing that is performed to determine if certain images or colors require different cleaning programs. This type of information can be used in conjunction with the feedback functionalities and the electronic controller 70 mentioned above. This would be considered by these inventors to be "adaptive profiling" 74. Most significantly, the combined functionality will be provided to optimize the cleaning process so that cleaning of the printing plates 62 is done in areas where cleaning is necessary and not done in areas where cleaning is not necessary, which minimizes the amount of time necessary to complete the cleaning cycle. The present invention is unique in its ability to clean specific areas of the printing plates 62 in this fashion. Again, the adaptive profiling technique disclosed herein is not limited to the specific disclosure discussed above, but could incorporate other technologies as well and the present invention is not so limited. The adaptive profiling technique can also be used to adapt to certain images and colors, each of which may require different cleaning programs.

Another performance optimization and enhancement feature can be to include the use of a camera sub-system (not shown), the camera sub-system can be coupled to the apparatus, system and method of the present invention. The camera sub-system similarly provides feedback information as to those specific areas of the printing plate 62 that require cleaning, similar to that which is described above. That is, information from the camera sub-system can be used to optimize the cleaning process by cleaning only those areas of the printing plate that need cleaning and then only as frequently as is necessary, all for optimization of the cleaning process.

Lastly, it has been found by these inventors that the apparatus, system and method of the present invention removes debris that can result in what are known to those skilled in the art as "hickeys" on the print sheet. Further, it has been found that the present invention also improves the printed image by maintaining a more consistent ink film on the printing plate 62. These optimization techniques are novel and patentably different from prior art methods that have been used for simply cleaning the printing plate 62.

The details of the invention having been disclosed in accordance with the foregoing, we claim:

1. A plate cleaner apparatus for dry cleaning a flexographic printing plate carried on a printing plate cylinder, the printing plate cylinder having a longitudinal axis, the plate cleaner apparatus comprising:

a frame disposed above the printing plate and the printing plate cylinder;

a track subassembly comprising a linear actuator motor, the frame being attached to the track subassembly and the frame being movable along the track subassembly via the linear actuator motor in a longitudinal direction that is parallel to the longitudinal axis of the printing plate cylinder;

an impression motor for enabling arcuate movement of the frame relative to the printing plate and the printing plate cylinder;

a roller that is movable upwardly and away from the printing plate and the printing plate cylinder via the impression motor and is alternatively movable downwardly and toward the printing plate and the printing plate cylinder via the impression motor;

an unwind spindle;

a rewind spindle;

a rewind motor for rotating the rewind spindle; and a web of dry cleaning material;

wherein the unwind spindle carries the web of dry cleaning material and the rewind spindle pulls the web of dry cleaning material from the unwind spindle and across a portion of the roller; and wherein a portion of the web of dry cleaning material passing over the roller is movable upwardly and away from the printing plate and the printing plate cylinder via the impression motor and is alternatively movable downwardly and toward the printing plate and the printing plate cylinder via the impression motor to clean that portion of the printing plate that the web contacts.

2. The plate cleaner apparatus of claim 1 wherein the roller comprises an outer surface and wherein a portion of the web of dry cleaning material is carried about a portion of such outer surface.

3. The plate cleaner apparatus of claim 1 wherein the print plate cylinder, the roller and the spindles each comprise a longitudinal axis, the axes of the roller and spindles being parallel to the axis of the print plate cylinder.

4. The plate cleaner apparatus of claim 1 further comprising a measuring device to determine the distance between the portion of web passing over the roller and the printing plate.

5. The plate cleaner apparatus of claim 1 further comprising an electronic controller that utilizes a controller network interface and an electronic control unit to monitor and control movement of the plate cleaner apparatus in accordance with a preprogrammed scheme.

6. The plate cleaner apparatus of claim 5 further comprising means for providing cleaning optimization feedback to the controller via at least one from a group consisting of:

automation in the setup of the apparatus;

ultrasound technology;

strain gauges for measuring torque;

a mapping and cleaning program;

adaptive profiling; and camera sub-systems;

wherein a consistent ink film is maintained on the print cylinder plate.

7. A printing press assembly comprising:

a flexographic plate that is carried on a printing plate cylinder, the printing plate cylinder having a longitudinal axis;

a subassembly for dry cleaning the flexographic plate that is carried on the plate cylinder within the printing press assembly, the subassembly comprising:

a frame disposed above the printing plate and the printing plate cylinder;

a track subassembly comprising a linear actuator motor, the frame being attached to the track subassembly and the frame being movable along the track subassembly via the linear actuator motor in a longitudinal direction that is parallel to the longitudinal axis of the printing plate cylinder;

an impression motor for enabling arcuate movement of the frame relative to the printing plate and the printing plate cylinder;

a roller that is movable upwardly and away from the printing plate and the printing plate cylinder via the impression motor and is alternatively movable downwardly and toward the printing plate and the printing plate cylinder via the impression motor;

an unwind spindle;

a rewind spindle;

a rewind motor for rotating the rewind spindle; and a web of dry cleaning material;

wherein the unwind spindle carries the web of dry cleaning material and the rewind spindle pulls the web of dry cleaning material from the unwind spindle and across a portion of the roller; and wherein a portion of the web of dry cleaning material passing over the roller is movable upwardly and away from the printing plate and the printing plate cylinder via the impression motor and is alternatively movable downwardly and toward the printing plate and the printing plate cylinder via the impression motor to clean that portion of the printing plate that the web contacts.

8. The printing press assembly of claim 7 wherein the roller of the subassembly comprises an outer surface and wherein a portion of the web of dry cleaning material of the subassembly is carried about a portion of such outer surface.

9. The printing press assembly of claim 7 wherein the print plate cylinder, the roller and the spindles each comprise an axis, the axes of the roller and spindles being parallel to the axis of the print plate cylinder.

10. The printing press assembly of claim 7 wherein the subassembly further comprises a measuring device to determine the distance between the portion of web passing over the roller and the printing plate.

11. The printing press assembly of claim 7 wherein the subassembly further comprises an electronic controller that utilizes a controller network interface and an electronic control unit to monitor and control the cleaner in accordance with a preprogrammed scheme.

12. The printing press assembly of claim 11 wherein the subassembly further comprises means for providing cleaning optimization feedback to the controller via at least one from a group consisting of:

automation in the setup of the apparatus;

ultrasound technology;

strain gauges for measuring torque;

a mapping and cleaning program;

adaptive profiling; and camera sub-systems;

wherein a consistent ink film is maintained on the print cylinder plate.

13. The printing press assembly of claim 7 wherein the dry cleaning subassembly is removable from the assembly.

* * * * *